US010184188B2

(12) United States Patent
Desai et al.

(10) Patent No.: US 10,184,188 B2
(45) Date of Patent: Jan. 22, 2019

(54) APPARATUS FOR USE IN AN ELECTROETCHING OR ELECTRODEPOSITION PROCESS AND AN ELECTROETCHING OR ELECTRODEPOSITION PROCESS

(71) Applicant: ROLLS-ROYCE plc, London (GB)

(72) Inventors: Alpesh Desai, Solihull (GB); Richard Keetley Davis, Nottingham (GB); Colin James Cook, Crook (GB)

(73) Assignee: ROLLS-ROYCE plc, London (GB)

( * ) Notice: Subject to any disclaimer, the term of this patent is extended or adjusted under 35 U.S.C. 154(b) by 290 days.

(21) Appl. No.: 15/040,399

(22) Filed: Feb. 10, 2016

(65) Prior Publication Data

US 2016/0258076 A1 Sep. 8, 2016

(30) Foreign Application Priority Data

Mar. 4, 2015 (GB) ..... 1503657.7

(51) Int. Cl.

| | |
|---|---|
| ***C25D 5/00*** | (2006.01) |
| ***C25D 5/04*** | (2006.01) |
| ***C25D 17/06*** | (2006.01) |
| ***C25D 17/12*** | (2006.01) |
| ***C25F 3/14*** | (2006.01) |
| ***C25F 7/00*** | (2006.01) |

(Continued)

(52) U.S. Cl.

CPC ..... *C25D 5/00* (2013.01); *C25D 5/04* (2013.01); *C25D 17/007* (2013.01); *C25D 17/06* (2013.01);

(Continued)

(58) Field of Classification Search

CPC ... C25D 5/00; C25D 5/04; C25D 7/04; C25D 17/007; C25D 17/06; C25D 17/08; C25D 17/12; C25F 3/02; C25F 3/14; C25F 7/00

See application file for complete search history.

(56) References Cited

U.S. PATENT DOCUMENTS 4,276,133 A 6/1981 Nagano et al.
5,109,589 A * 5/1992 Cramer ..... C25D 1/10 29/424

(Continued)

FOREIGN PATENT DOCUMENTS

EP 2540876 A1 1/2013
GB 1153015 A 5/1969

(Continued)

OTHER PUBLICATIONS

Jan. 28, 2016 Search Report issued in British Patent Application No. GB1503657.7.

(Continued)

*Primary Examiner* — Ciel P Thomas
(74) *Attorney, Agent, or Firm* — Oliff PLC

(57) ABSTRACT

There is disclosed an apparatus for use in an electroetching or electrodeposition process in which material is etched from or deposited onto the surface of an electrically conductive component. The apparatus comprises a support for supporting the component within a tank containing an electrolytic solution; and a first-polarity electrode arranged to be located within the tank and immersed in the electrolytic solution and shaped to surround at least a part of the component in a contactless manner. In use, an electric field produced by the first-polarity electrode results in an electric variance between at least a part of the component and a second-polarity electrode having a polarity opposite to that of the first-polarity electrode. An electroetching and an electrodeposition process are also disclosed.

17 Claims, 4 Drawing Sheets

(51) Int. Cl.

| | |
|---|---|
| ***C25D 17/08*** | (2006.01) |
| ***C25F 3/02*** | (2006.01) |
| ***C25D 17/00*** | (2006.01) |
| ***C25D 7/04*** | (2006.01) |

(52) U.S. Cl.
CPC ..... *C25D 17/08* (2013.01); *C25D 17/12* (2013.01); *C25F 3/02* (2013.01); *C25F 3/14* (2013.01); *C25F 7/00* (2013.01); *C25D 7/04* (2013.01)

(56) References Cited

U.S. PATENT DOCUMENTS

| | | | | |
|---|---|---|---|---|
| 5,908,540 | A * | 6/1999 | Fanti | C25D 17/12 204/242 |
| 6,132,586 | A * | 10/2000 | Adams | H01L 21/2885 205/123 |
| 2007/0034528 | A1 * | 2/2007 | Diaz | C25F 3/16 205/686 |

FOREIGN PATENT DOCUMENTS

| | | | |
|---|---|---|---|
| GB | 1240908 | A | 7/1971 |
| JP | S60-211093 | A | 10/1985 |
| WO | 2014/088944 | A1 | 6/2014 |

OTHER PUBLICATIONS

Mar. 24, 2016 Search Report issued in European Patent Application No. 16154750.

* cited by examiner

APPARATUS FOR USE IN AN ELECTROETCHING OR ELECTRODEPOSITION PROCESS AND AN ELECTROETCHING OR ELECTRODEPOSITION PROCESS

CROSS-REFERENCE TO RELATED APPLICATIONS

This application is based upon and claims the benefit of priority from British Patent Application Number 1503657.7 filed 4 Mar. 2015, the entire contents of which are incorporated by reference.

BACKGROUND

1. Field of the Disclosure

The disclosure relates to an apparatus for use in an electroetching or an electrodeposition process, and an electroetching or an electrodeposition process.

2. Description of the Related Art

The disclosure relates to an apparatus for use in an electroetching or an electrodeposition process, and an electroetching or an electrodeposition process.

The metallurgical structure of metal components are commonly inspected by non-destructive means to determine their quality. For example, an aircraft component such as a gas turbine disc may be inspected for material and machining anomalies. Typically, before inspecting the metallurgical structure a surface layer of the component is removed by electroetching.

In a previously considered electroetching process, to enable surface preparation, a component is physically attached to an anode and is immersed in a electrolytic solution contained within a tank which acts as a cathode. When a voltage is applied across the anode/cathode, the component acts as an anode due to the physical electrical connection. As such, material is etched from its surface. Whilst such a process may be satisfactory, it may be labour intensive and it may be difficult to uniformly etch the surface of the component.

OBJECTS AND SUMMARY

It is therefore desirable to provide an improved apparatus for use in an electroetching or an electrodeposition process, and an electroetching or an electrodeposition process.

According to an aspect there is provided an apparatus for use in an electroetching or electrodeposition process in which material is etched from or deposited onto the surface of an electrically conductive component, the apparatus comprising: a support for supporting the component within a tank containing an electrolytic solution; and a first-polarity electrode arranged to be located within the tank and immersed in the electrolytic solution and shaped to surround at least a part of the component in a contactless manner. In use an electric field produced by the first-polarity electrode may result in an electric variance (for example an electric potential difference) between at least a part of the component and a second-polarity electrode having a polarity opposite to that of the first-polarity electrode. The electric field may induce an electric charge in at least a part of the component. The electric field may induce an electric variance (for example an electric potential) in at least a part of the component. The electric field may induce an electric potential difference in at least a part of the component. The first-polarity electrode may be a contactless electrode. The first-polarity electrode may be separate from the tank. The first-polarity electrode may be an anode in which case the apparatus is for an electroetching process. Alternatively, the first-polarity electrode may be a cathode in which case the apparatus is for an electrodeposition process. There may be a second-polarity electrode having a polarity opposite to that of the first-polarity electrode. In other words, if the first-polarity electrode is an anode then the second-polarity electrode is a cathode, and if the first-polarity electrode is a cathode then the second-polarity electrode is an anode. The second-polarity electrode may also not be in contact with the component. The component may be closer to the first-polarity electrode than the second-polarity electrode. The second-polarity electrode may be in direct contact with the electrolytic solution. In one arrangement the second-polarity electrode may form part of the tank. In another arrangement the second-polarity electrode may be a separate electrode immersed in the electrolytic solution. There may be a plurality of first-polarity electrodes and/or there may be a plurality of second-polarity electrodes. In use, the component may not be physically connected to any electrode.

Where the term "electric variance" is used herein, this may mean any suitable electric parameter, for example any one or more of: current, voltage (or potential/potential difference), electromotive force (emf) and/or capacitance.

The first-polarity electrode may comprise first and second side limbs spaced apart to at least partly define an electrode space arranged to receive at least a part of the component. The first and second side limbs may be attached together by a cross-piece. The first and second side limbs may extend in substantially parallel directions. The first and second side limbs may each comprise an electrode surface arranged to face first and second opposing surfaces of the component respectively. Parts of the first-polarity electrode which in use face away from the component may be provided with an insulating coating. The first-polarity electrode may define an electrode space. The shape of a cross-section of the first-polarity electrode space may correspond to the shape of a cross-section of at least a part of the component. For example, if the component has a rectangular cross-section the electrode space defined by the first-polarity electrode may have a rectangular cross-section (in the same plane), albeit slightly larger than the cross-section of the component.

The first-polarity electrode may form a closed loop. The first-polarity electrode may have a first configuration in which it forms a closed loop and a second configuration in which the first-polarity electrode does not form a closed loop. In the second configuration (which may be a set-up configuration) a component may be located within the first-polarity electrode, and in the second configuration (which may be an operational configuration) the closed-loop may be closed around the component. The first-polarity electrode may have a removable section or a moveable section.

The first-polarity electrode may be supported by the support. The first-polarity electrode may be insulated from the support. The first-polarity electrode may have a fixed relationship with the support.

The apparatus may further comprise a drive for causing relative movement between the component and the first-polarity electrode. The drive may be arranged to cause rotational movement. The drive may be arranged to rotationally drive the component. The drive may comprise a motor. The drive may comprise one or more wheels, gears or cogs arranged to rotate the component. The drive may be arranged to cause movement of the component through an electrode space defined by the first-polarity electrode. The shape of a cross-section of the component in a plane perpendicular to the direction of movement may correspond to a shape of the cross-section of the component in a plane perpendicular to the direction of movement. The component may be rotated by a rotatable drive member that cooperates with a complementary feature of the component. For example, the complementary feature of the component may be teeth, fir trees, bores or holes.

The apparatus may be arranged such that the distances between the component and the first-polarity electrode remain substantially constant during relative movement between the component and the first-polarity electrode caused by the drive.

The first-polarity electrode may be shaped such that the minimum distance between the surface of the part of the component which the first-polarity electrode surrounds and the surface of the first-polarity electrode is at least 1 mm, at least 2 mm, at least 3 mm or at least 4 mm. The first-polarity electrode may be shaped such that the maximum distance between the surface of the component which the first-polarity electrode surrounds and the surface of the first-polarity electrode may be 100 mm or less, 95 mm or less, 90 mm or less, 85 mm or less, 80 mm or less, 75 mm or less, 70 mm or less, 65 mm or less, 60 mm or less, 55 mm or less, 50 mm or less, 45 mm or less, 40 mm or less, 35 mm or less, 30 mm or less, 25 mm or less, 20 mm or less, or 15 mm or less.

At least a part of the drive may be arranged to support the component. For example, a gear or wheel may support the component. At least a part of the drive may be supported by the support. At least a part of the drive may be arranged to be immersed in the electrolytic solution.

The support may be attached to a frame which can be located within the tank of electrolytic solution. The frame may comprise at least one lifting point. The frame may support an electrical power source electrically coupled to the first-polarity electrode. The support may be attached to a central region of the frame. The external dimensions of the frame may be only slightly less or comparable to the internal dimensions of the tank.

The apparatus may further comprise a second-polarity electrode arranged to extend into a cavity of the component. The second-polarity electrode may have a polarity opposite to that of the first-polarity electrode.

The apparatus may further comprise a tank for containing electrolytic solution. At least a part of the tank, such as a wall of the tank or a lining of the tank, may form a second-polarity electrode having a polarity opposite to that of the first-polarity electrode.

According to another aspect there is provided an electroetching or an electrodeposition process comprising: supporting an electrically conductive component within a tank of electrolytic solution with a first-polarity electrode immersed in the electrolytic solution and surrounding at least a part of the component in a contactless manner; and applying a voltage between the first-polarity electrode and a second-polarity electrode in contact with the electrolytic solution but not in contact with the component such that the first-polarity electrode produces an electric field, thereby causing material to be etched from or deposited onto the surface of the component. The electric field produced by the first-polarity electrode may result in an variance (for example an electric potential difference) between at least a part of the component and the second-polarity electrode, thereby causing material to be etched from or deposited onto the surface of the component. The electric field may contactlessly induce an electric charge in at least a part of the component. The electric field may contactlessly induce an electric variance (for example an electrical potential) in at least a part of the component. The electric field may contactlessly induce an electric potential difference in at least a part of the component. The first-polarity electrode may be an anode in which case the method is an electroetching process. Alternatively, the first-polarity electrode may be a cathode in which case the method is an electrodeposition process. The second-polarity electrode may have a polarity opposite to that of the first-polarity electrode. In the process, there may be no direct electrical connection between either of the electrodes and the component.

The method may further comprise causing relative movement between the component and the first-polarity electrode during the electrolytic process. The movement may be rotational movement. The component may be rotated. The component may be moved, such as rotated, through an electrode space defined by the first-polarity electrode. The distances between the component and the first-polarity electrode may remain substantially constant during relative movement between the component and the first-polarity electrode. The minimum distance between the surface of the part of the component which the first-polarity electrode surrounds and the surface of the first-polarity electrode may be at least 1 mm, at least 2 mm, at least 3 mm or at least 4 mm. The maximum distance between the surface of the component which the first-polarity electrode surrounds and the surface of the first-polarity electrode may be 100 mm or less, 95 mm or less, 90 mm or less, 85 mm or less, 80 mm or less, 75 mm or less, 70 mm or less, 65 mm or less, 60 mm or less, 55 mm or less, 50 mm or less, 45 mm or less, 40 mm or less, 35 mm or less, 30 mm or less, 25 mm or less, 20 mm or less, or 15 mm or less.

The component may be closer to the first-polarity electrode than the tank. At least a part of the tank, such as a wall or lining, may form the second-polarity electrode.

BRIEF DESCRIPTION OF THE DRAWINGS

Arrangements will now be described, by way of example, with reference to the accompanying drawings, in which.

DETAILED DESCRIPTION OF EMBODIMENTS

Figure 1:
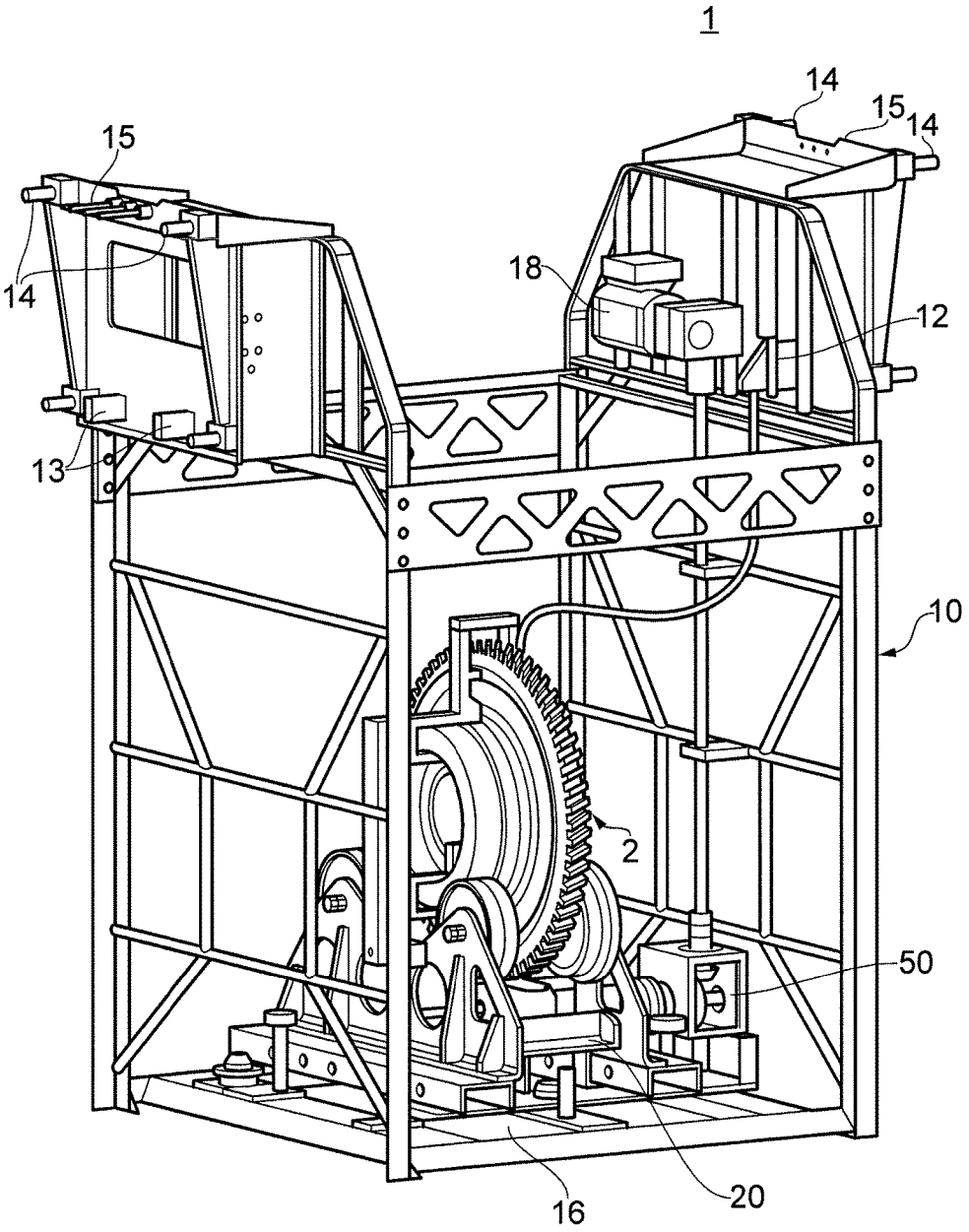
FIG. 1 schematically shows an apparatus for use in an electroetching process.

FIG. 1 shows an apparatus 1 for use in an electroetching process in which metal is etched (or removed) from the surface of an electrically conductive component 2. In this arrangement the component 2 is a gas turbine disc, but it should be appreciated that the apparatus is suitable for etching any type of component 2. The apparatus 1 comprises a frame 10 having a first polarity electrode terminal 12, two second polarity electrode terminals 13, two motor terminals 15, and a motor 18 mounted in an upper region thereof. The frame 10 is provided with lifting points 14 such that it can be picked-up and lowered using a lifting mechanism (such as a robotic arm or transporter for example). The frame 10 comprises a base 16 to which an assembly 20 for supporting the component 2 is attached. In use, the frame 10 is located within a tank of electrolytic solution (not shown) to electrochemically etch the surface of a component 2 supported by the assembly 20.

Figure 2:
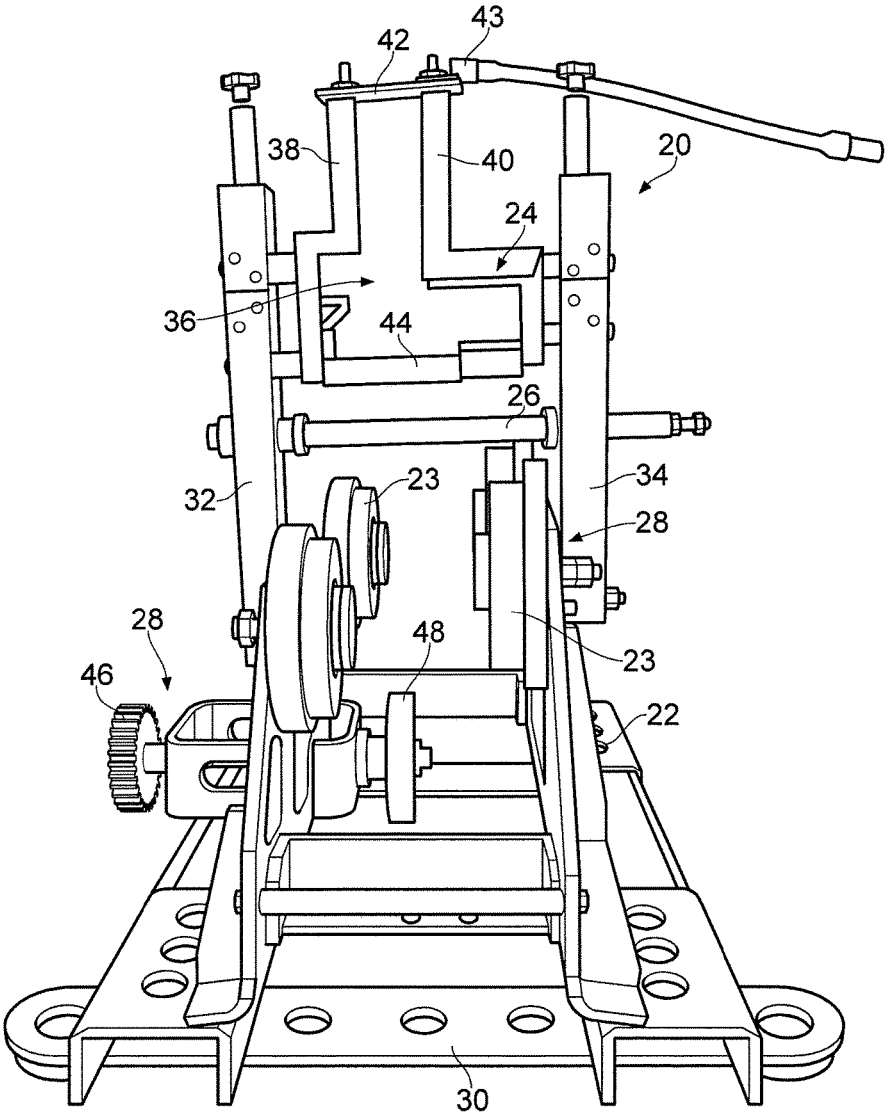
FIG. 2 schematically shows the apparatus of FIG. 1 without the frame.

Referring now to FIG. 2, the assembly 20 comprises a support 22 for supporting the component 2, an anode (first-polarity electrode) 24 for surrounding a part of the component 2 in a contactless manner, an auxiliary cathode (second-polarity electrode) 26 which extends through a cavity in the component 2 and a rotational drive mechanism 28 for rotating the component 2 with respect to the anode 24.

The support 22 comprises a support base 30 and a pair of first and second horizontally spaced support posts 32, 34. The first and second support posts 32, 34 are connected to and extend upwardly from the support base 30. The support also 22 comprises a four rollers 23 rotatably mounted to the support 22 about parallel axes. Two rollers 23 are located on each side of the support 22 for supporting the component 2. The support base 30 is attached to the base of the frame 10.

The anode (first-polarity electrode) 24 is attached to an upper region of the support between the two support posts 32, 34. The anode 24 is electrically insulated from the support posts 32, 34. In this arrangement the anode 24 is of a closed-loop structure defining an electrode space 36. The shape of the electrode space corresponds to the shape of the cross-section of a part of the component 2 to be etched, and, in the embodiment shown is planar. The closed-loop anode 24 comprises first and second side limbs 38, 40 laterally spaced apart and arranged to be located either side of the component 2. The first and second side limbs 38, 40 comprise exposed electrode surfaces that are arranged to face the component 2 (i.e. the electrode space 36). The remaining surfaces of the side limbs 38, 40 are coated with an insulating material such as polypropylene. The anode 24 also comprises an electrically conductive upper cross-member 42 which connects the upper ends of the side limbs 38, 40. Further, the anode 24 comprises an electrically conductive removable lower cross-member 44 that is connected between the lower ends of the side limbs 38, 40. This lower cross-member 44 is removable so that the closed-loop can be "opened". To summarise, in this arrangement, the closed-loop anode 24 is formed by the two side-limbs 38, 40 and the two cross-members 42, 44.

The auxiliary cathode (second-polarity electrode) 26 is in the form of a metal rod, and is removably supported by and extends between the first and second support beams 32, 34. The auxiliary cathode 26 is also electrically insulated from the support beans 32, 34. The auxiliary cathode 26 lies in the general plane of the electrode space 36.

The rotational drive mechanism 28 comprises a driven gear 46 and a driving gear 48 which is located towards the bottom of the support 22 in between the two support posts 32, 34. The driven gear 46 and the driving gear 48 are connected together by a shaft (not shown). In use, the driving gear 48 acts to rotate the component 2.

Referring back to FIG. 1, the assembly 20 is mounted within the frame 10 and the first and second polarity electrode terminals 12, 13 are connected to the anode 24 and the auxiliary cathode 26 respectively, by way of wires and copper connectors. The motor terminals 15 are connected to the motor 18. The first polarity electrode terminal 12 is connected to the cross-member 42 of the anode 24 at a cross-member contact point 43. The motor 18 is connected to the driven gear 46 through a transmission 50 such that the motor 18 can be operated to drive the driven gear 46. In order to perform an electroetching process a component 2 must be mounted to the assembly 20.

Figure 3:
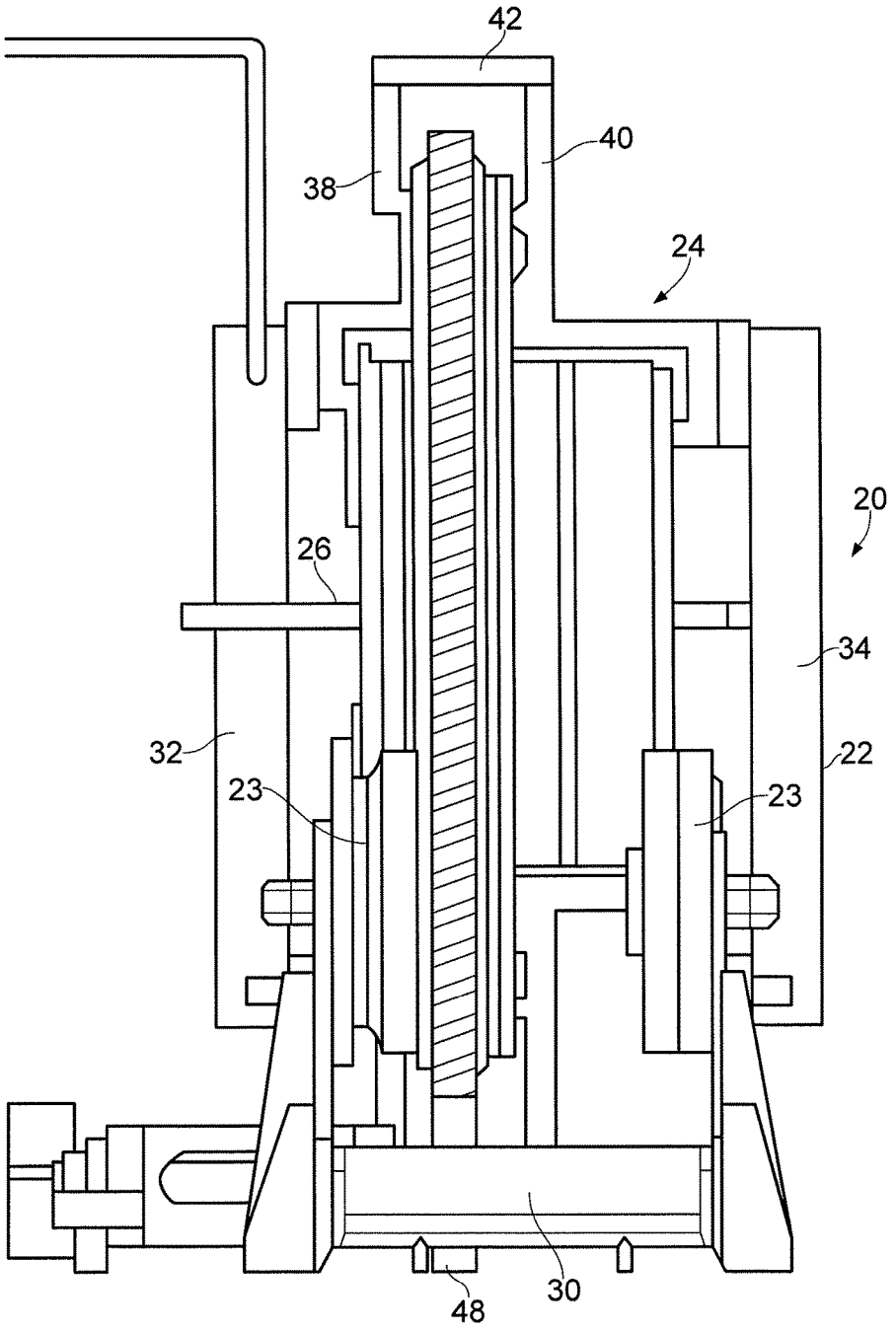
FIG. 3 schematically shows the apparatus of FIG. 1 with a component supported by the support.

FIG. 3 shows a metal gas turbine disc 2 having a central bore mounted to the assembly 20. The disc 2 may comprise a nickel, titanium, aluminium, or steel alloy. In other arrangements, the disc 2 may comprise a heat resistant super alloy or any other electrically conductive material. In use, the disc 2 may be subjected to temperatures in excess of 1800° C. In order to mount the disc 2 to the assembly 20 the auxiliary cathode 26 and the lower cross-member 44 are removed. The disc 2 is then located within the support 22 between the two support posts 32, 34 and parts of the disc 2 are supported by the rollers 23. In this arrangement, the outer circumference of the disc 2 is toothed and engages with the driving gear 48. This allows the disc 2 to be rotated about its axis using the motor 18. It will be appreciated that the component could be rotated by a rotatable driving member which engages with another type of complementary feature of the component (e.g. fir trees, bores, or holes). Once supported within the support 22, the auxiliary cathode 26 and the lower cross-member 44 are replaced such that they extend through the bore of the disc 2.

Figure 4:
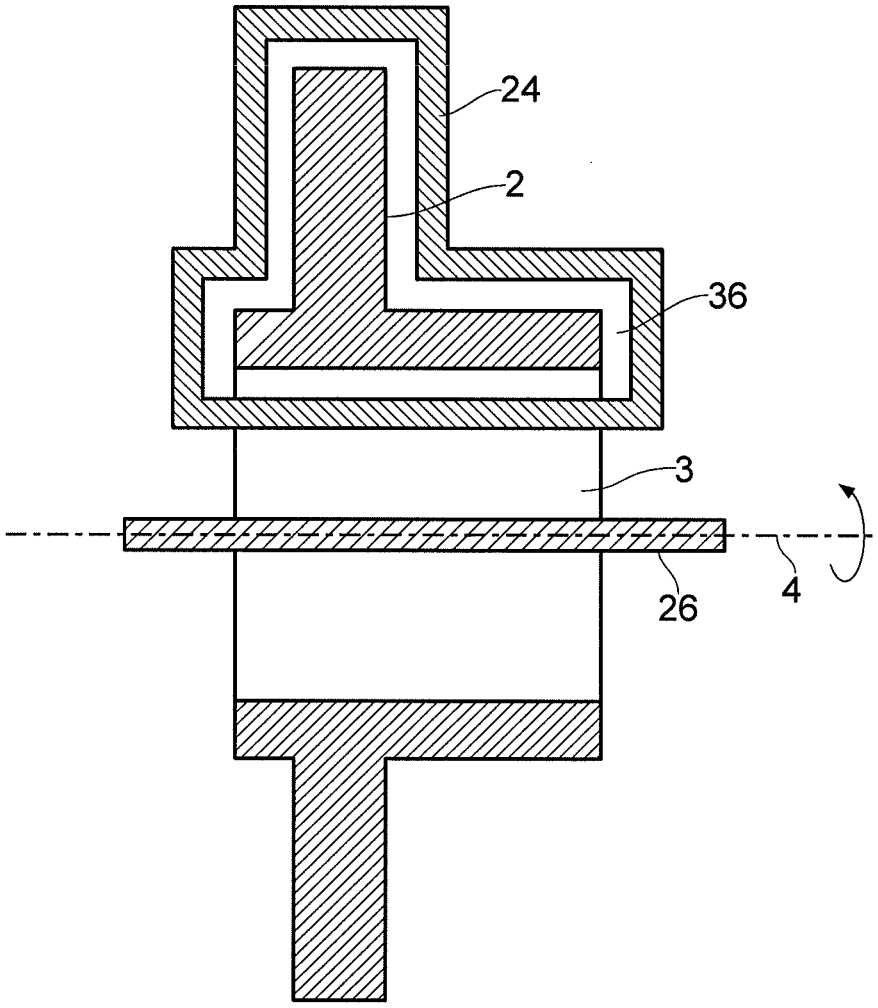
FIG. 4 schematically shows a cross-sectional view through the anode, auxiliary cathode and component of FIG. 3.

Referring now to FIG. 4, which shows a cross-sectional view in a vertical plane that intersects the axis 4 of the disc 2 and is parallel to the plane of the anode 24, it can be seen that the interior shape of the anode 24 corresponds to the shape of a cross-section of the disc 2. As can be seen, the closed-loop anode 24 surrounds a part of the disc 2 in a contactless manner (i.e. there is no physical contact between the anode 24 and the disc). In this arrangement, the distance between the interior surface of the anode 24 facing the disc 2 and the surface of the disc 2 is substantially constant. The distance may be in the range of 1 mm-100 mm. In another arrangement the distance may be in the range of 4 mm-15 mm. The auxiliary cathode 26 extends through the bore 3 of the disc 2 and is located along the axis 4 of the disc 2. There is also no physical contact between the auxiliary cathode 26 and the disc 2. As the disc 2 is rotated about its axis 4, the relative spacing between the anode 24 and the auxiliary cathode 26, and the component 2 remains constant. At no point in the rotational cycle does the disc 2 make contact with either the anode 24 or the auxiliary cathode 26. However, due to the rotation of the disc, different parts of the disc 2 pass through the electrode space 36 defined by the anode 24.

With the component 2 mounted to the assembly 20, the frame 10 is lifted using lifting apparatus, such as a robotic arm (or transporter) (not shown), which grasps the lifting points 14 on the frame 10. The frame 10 is then lowered into a tank of electrolytic solution (not shown). In this arrangement the electrolytic solution is sulphuric acid having a concentration of around 60%. However, other electrolytic solutions such as phosphoric acid, ferric chloride, hydrochloric acid, Metrex 629, trisodium phosphate, mixtures thereof, and those containing caustic soda and sodium cyanide may instead be used. With the frame 10 located in the tank, the component 2, the anode 24 and the auxiliary cathode 26 are fully submerged within the electrolytic solution. Since the first polarity electrode terminal 12, second polarity electrode terminals 13 and motor 18 are located in an upper region of the frame 10, they are not in contact with the electrolytic solution. The internal dimensions of the tank are slightly larger than the external dimensions of the frame 10. This means that the frame 10 can only be located substantially centrally within the tank, and thus the assembly 20 and component 2 are also located substantially centrally within the tank. In this arrangement, the tank is provided with a metal lining which forms a main cathode (second-polarity cathode).

In order to commence the electroetching process, a power supply is attached to the first and second polarity electrode terminals 12, 13 and the part of the tank which forms a second-polarity electrode. The power supply is turned on such that a voltage is applied between the contactless anode 24 and the main cathode/auxiliary cathode 26 and/or the contactless anode 24 and the tank. The contactless anode 24 generates an electric field (or "halo") and due to the proximity of the metal component 2 to the anode 24, the electric field induces an electric variance (such as an electric potential and/or electric charge) in a part of the component resulting in, for example, an electric potential difference between the part of the component and the cathode. The part of the component 2 which the anode 24 surrounds therefore becomes positively charged, and thus acts as an anode, without the need of a physical electrical connection between the anode 24 and the component 2. This electrical variance (for example potential difference) between the component 2 and the metal lining of the tank causes the metal surface of the component 2 to be dissolved into the electrolytic solution, thereby exposing the underlying metal structure. In this arrangement, the voltage is around 10V and the output current is between 100-450 A. In order to evenly etch the entire surface of the component 2, it is rotated about its axis 4 by operating the rotational drive mechanism 28. In particular, the component 2 is rotated so that the component 2 is moved through the closed-loop anode 24 in a direction perpendicular to the plane of the anode 24. This causes different regions of the component 2 to become positively charged by induction, thereby resulting in the surface being etched. In this arrangement the component 2 is rotated at a speed of between 4-12 rpm. In order to etch the entire surface of the component 2, the component 2 is rotated by the rotational drive mechanism 28 through at least one revolution. However, in this arrangement the etch process has a duration of between 5-25 minutes. Typically, material is removed to a depth of around 5 μm so as to maintain the dimensional tolerance of the component 2. The auxiliary cathode 26 is provided to promote etching of the inwardly surfaces of the bore 3 of the component 2. However, it should be appreciated that an auxiliary cathode 26 is not essential.

After the component 2 has been etched to a sufficient depth, the power supply to the first and second polarity electrode terminals 12, 13 and the motor 18 are turned off and the frame 10 is lifted out of the tank using lifting apparatus. The component 2 is then removed from the assembly 20 by removing the lower cross-member 44 and the auxiliary cathode 26. The metallurgical structure of the etched component 2 can then be examined.

Although not shown, the etching process may be automated by an etching controller which controls the rotational speed of the rotational drive mechanism 28 and also controls the voltage applied between the anode 24 and the cathodes. The etching controller may act to switch between the main cathode (the metal lining of the tank) and the auxiliary cathode 26 to ensure that the component 2 is etched evenly. The controller may also be configured to control a robotic arm (or transporter).

The etching process may be followed by a number of additional processing steps, such as rinsing, desmutting, neutralising, drying and inspection. Rinsing may be carried out with water having a conductivity of less than 500 μS/cm. Further, the etching process may be preceded by a number of preparation steps, such as degreasing, rinsing and electrolytic cleaning. Electrolytic cleaning may be performed, for example, by rotating the component 2 through the electrode space 28 with the electrolytic solution present. Alternatively, electrolytic cleaning may be performed by reducing the voltage and/or time and/or by changing the electrolytic solution. Each additional step may be carried out in a separate tank. Accordingly, between each step, the frame 10 may be moved by way of a robotic arm (or transporter), between the tanks.

In some circumstances, it may be necessary to etch only certain regions of the component 2. For example, it may only be necessary to only etch a reduced area, such as a weld line of the component 2 and the regions surrounding it. Accordingly, regions of the anode surfaces corresponding to regions of the component 2 that do not require etching may be covered (i.e. masked) in an insulator such as polypropylene.

It should be appreciated that the depth of the etch is dependent on a number of factors such as the duration of etch, the electrode material, the rotational speed of the component, air pockets in the solution created by the component 2, the location of the power source connection to the anode 24, the distance between the anode 24 and the component 2, the size and shape of the anode 24, the voltage and current applied, the type of electrolytic solution and the material of the component 2 to be etched. Accordingly, these variables may be controlled so as to produce the desired etch. For example, the rotational speed of the component 2 may be reduced and/or the size of the interior surface of the anode 24 facing the component 2 may be increased so as to expose regions of the component 2 to the anode 24 for longer periods of time, thereby producing a deeper etch. The operational parameters may remain constant for the entire electroetching process, or they may vary over time. For example, if a component 2 is not axisymmetric, the voltage may be varied so as to compensate for the varying distance between it and the anode 24 as the component 2 rotates. Further, the width of the anode 24 may vary along its length so as to preferentially etch certain regions of the component 2, or to compensate for the varying distance between the anode 24 and the component 2 along the length of the anode 24.

Although the first-polarity electrode which surrounds the component (i.e. the anode 24 in the arrangement described above) has been described as being a closed-loop anode 24, it may have any suitable shape. For example, if the component 2 does not have an internal bore, the anode 24 may be U-shaped.

In the above arrangement it has been described that the component 2 is moved with respect to the first-polarity electrode 24. However, in other arrangements the first-polarity electrode 24 may be moved with respect the component 2. Further, in other arrangements there may be linear, rather than rotational, movement between the component 2 and the contactless first-polarity electrode.

In the arrangement described above there is no physical electrical contact between the component 2 to be etched the electrode 24. Since the first-polarity electrode is spaced from the component 2 by a sufficient controlled distance, the risk of "arcing" is significantly reduced if not completely eliminated. Arcing changes the grain structure of the material of the component 2, which in turn negatively affects its life, necessitating the scrapping of components. Accordingly, the arrangement described above avoids the component 2 being damaged during etching, which would necessitate it being reworked or scrapped. Further, since the component is moved through the electric field generated by the first-polarity electrode, a uniform etch is performed. In addition, in the arrangement described above the component 2 is automatically moved with respect to the first-polarity electrode which helps to provide a uniform etch. This automation may reduce the manual intervention required by a previously considered electroetching process, in which it is necessary to manually index the component by periodically removing and reapplying physical contacts, and may therefore result in the method being less labour intensive and less expensive as a result. Further, the entire etching process, including additional processing steps, may be automated once the component 2 has been secured in the apparatus 1. A single structure may be used for multiple processing steps, and movement of the structure between tanks may be automated. Accordingly, the cost and complexity of the entire etching process is reduced. Further, the level of operator intervention required for structure changeover is reduced, which in turn reduces the health and safety risks to the operator.

In the foregoing description an electroetching process and an apparatus for use in an electroetching process has been described. It should be appreciated that the term "electroetching" also covers cleaning a component by removing material from the surface of the component. The apparatus could be used in an electrodeposition process in which material is deposited onto the surface of a conductive component, such as a gas turbine disc. In such an arrangement the first-polarity electrode 24 would be a cathode and the second-polarity electrode (such as the tank) would be an anode. The electrolytic solution used may also be different in order to promote deposition. The method would be substantially the same in as much as the first-polarity electrode (cathode) would surround the component in a contactless manner and generate an electric field to induce a negative charge in regions of the component. The component may be moved in a similar manner to cause uniform deposition on the surface of the component. Typical deposition materials are chromium, cadmium, silver, nickel, copper, tin and cobalt, with suitable voltages, currents, time and temperatures used to obtain the desired deposition layer.

We claim:

1. An apparatus for use in an electroetching or electrodeposition process in which material is etched from or deposited onto a surface of an electrically conductive component having a cavity, the apparatus comprising;

a support for supporting the component within a tank containing an electrolytic solution;

a first-polarity electrode arranged to be located within the tank and immersed in the electrolytic solution and shaped to surround at least a part of the component in a contactless manner;

a second-polarity electrode which is in contact with the electrolytic solution but not in contact with the component, and which has a polarity opposite to that of the first-polarity electrode; and an auxiliary second polarity electrode arranged to be immersed in the electrolytic solution and arranged to extend through the cavity of the component, and which has a polarity opposite to that of the first-polarity electrode;

such that in use an electric field produced by the first-polarity electrode results in an electric variance between at least a part of the component and at least one of:

the second polarity electrode, and the auxiliary second-polarity electrode.

2. An apparatus according to claim 1, wherein the first-polarity electrode comprises first and second side limbs spaced apart to at least partly define an electrode space arranged to receive at least a part of the component.

3. An apparatus according to claim 1, wherein the first-polarity electrode defines an electrode space and wherein the shape of a cross-section of the first-polarity electrode space corresponds to the shape of a cross-section of at least a part of the component.

4. An apparatus according to claim 1, wherein the first-polarity electrode forms a closed loop.

5. An apparatus according to claim 4, wherein the first-polarity electrode has a first configuration in which it forms a closed loop and a second configuration in which the first-polarity electrode does not form a closed loop.

6. An apparatus according to claim 1, wherein the first-polarity electrode is supported by the support.

7. An apparatus according to claim 6, wherein the first-polarity electrode is insulated from the support.

8. An apparatus according to claim 1, further comprising a drive for causing relative movement between the component and the first-polarity electrode.

9. An apparatus according to claim 8, wherein the drive is arranged to rotationally drive the component.

10. An apparatus according to claim 8, wherein the apparatus is arranged such that the distances between the component and the first-polarity electrode remain substantially constant during relative movement between the component and the first-polarity electrode caused by the drive.

11. An apparatus according to claim 1, wherein the support is attached to a frame which can be located within the tank of electrolytic solution.

12. An apparatus according to claim 10, further comprising an electrical power source electrically coupled to the first-polarity electrode.

13. A method comprising:

providing the apparatus of claim 1;

supporting the electrically conductive component within the tank with the first polarity electrode surrounding at least a part of the component in a contactless manner; and applying a voltage between the first-polarity electrode and at least one of the second-polarity electrode and the auxiliary second-polarity electrode to cause an electric variance between said at least a part of the component and the second polarity electrode or the auxiliary second-polarity electrode.

14. A method according to claim 13, further comprising causing relative movement between the component and the first-polarity electrode during the electrolysis.

15. A method according to claim 14, wherein the component is rotated.

16. A method according to claim 13, wherein the distances between the component and the first-polarity electrode remain substantially constant during relative movement between the component and the first-polarity electrode.

17. A method according to claim 13, wherein at least a part of the tank forms the second-polarity electrode.

* * * * *